US009725936B2

(12) United States Patent
Header

(10) Patent No.: US 9,725,936 B2
(45) Date of Patent: Aug. 8, 2017

(54) DOOR CATCH

(71) Applicant: Gregory Header, Richland, PA (US)

(72) Inventor: Gregory Header, Richland, PA (US)

( * ) Notice: Subject to any disclaimer, the term of this patent is extended or adjusted under 35 U.S.C. 154(b) by 40 days.

(21) Appl. No.: 14/957,605

(22) Filed: Dec. 3, 2015

(65) Prior Publication Data

US 2016/0083985 A1 Mar. 24, 2016

Related U.S. Application Data

(62) Division of application No. 13/960,308, filed on Aug. 6, 2013, now Pat. No. 9,228,387.

(51) Int. Cl.

| | |
|---|---|
| ***E05C 19/00*** | (2006.01) |
| ***E05C 19/04*** | (2006.01) |
| ***E05F 5/02*** | (2006.01) |
| ***E05C 17/46*** | (2006.01) |
| ***E05C 17/52*** | (2006.01) |
| *E05B 15/02* | (2006.01) |

(52) U.S. Cl.

CPC ..... *E05C 19/04* (2013.01); *E05C 17/46* (2013.01); *E05C 17/52* (2013.01); *E05F 5/02* (2013.01); *Y10T 16/61* (2015.01)

(58) Field of Classification Search

CPC ..... Y10S 292/60; E05F 5/02

USPC ..... 292/DIG. 60

See application file for complete search history.

(56) References Cited

U.S. PATENT DOCUMENTS

| | | | |
|---|---|---|---|
| 41,451 | A | 2/1864 | Streeter |
| 389,110 | A | 9/1888 | Roselius |
| 392,133 | A | 10/1888 | Peck |
| 945,461 | A | 1/1910 | Hubbard |

(Continued)

FOREIGN PATENT DOCUMENTS

| | | | |
|---|---|---|---|
| CH | 104523 | A | 5/1924 |
| CH | 244295 | A | 9/1946 |

(Continued)

OTHER PUBLICATIONS

Roller and Ball Catches, accessed on the Internet at: http://www.baldwinhardware.com/products/categories/Accessories/Door-Accessories/Roller-Ball-Catches.aspx on Jul. 22, 2013.

(Continued)

*Primary Examiner* — Alyson M Merlino

(74) *Attorney, Agent, or Firm* — Stone Creek Services LLC; Alan M Flum

(57) ABSTRACT

Disclosed is a door catch that can help to prevent door sag, especially for heavy or tall residential or commercial doors, and provides for post-installation catch tension adjustment without removal or adjustment of mounting members. In one aspect, the door catch can include a ball catch base, a threaded ball plunger assembly, a catch bumper, and a bumper base. In another aspect, the catch bumper and the bumper base can optionally be combined into a single catch bar bracket. The ball plunger assembly is adjustably mounted within a threaded aperture of ball catch base. A ball captive in one end of the ball plunger assembly engages a detent in the catch bumper, or catch bar bracket, providing friction to hold the door open. The position of the ball plunger assembly can be adjusted vertically to increase or decrease the tension between the detent and the ball plunger assembly.

2 Claims, 17 Drawing Sheets

(56) References Cited

U.S. PATENT DOCUMENTS

| | | | | |
|---|---|---|---|---|
| 1,089,891 | A | | 3/1914 | Woolley |
| 1,100,249 | A | | 6/1914 | Newsam |
| 1,102,207 | A | | 6/1914 | Belknap |
| 1,069,932 | A | | 8/1914 | Dupart |
| 1,330,945 | A | | 2/1920 | Kuhn |
| 1,356,685 | A | | 10/1920 | Allmand |
| 1,383,582 | A | | 7/1921 | Stubbs |
| 1,449,477 | A | | 3/1923 | Wiley |
| 1,501,584 | A | * | 7/1924 | Cox ..... E05D 13/06 292/73 |
| 1,514,845 | A | | 11/1924 | Fischer |
| 1,686,805 | A | | 10/1928 | Forg |
| 1,692,366 | A | | 11/1928 | Bean |
| 1,914,542 | A | | 6/1933 | Teich |
| 1,941,576 | A | | 1/1934 | Pond |
| 1,969,749 | A | | 8/1934 | Harsh |
| 2,043,550 | A | * | 6/1936 | Mumbrauer ..... E05C 19/04 292/75 |
| 2,087,001 | A | | 7/1937 | Johnson |
| 2,108,326 | A | | 2/1938 | Adams |
| 2,439,057 | A | | 4/1948 | Russell |
| 2,496,691 | A | | 2/1950 | Berry |
| 2,503,076 | A | | 4/1950 | Smith |
| 2,518,992 | A | | 8/1950 | Kubatzky |
| 2,519,011 | A | | 8/1950 | Aurandt |
| 2,526,539 | A | | 10/1950 | Carrol |
| 2,809,061 | A | | 11/1953 | Beyer |
| 2,885,237 | A | | 5/1959 | Heyer |
| 2,990,207 | A | | 6/1961 | Heyer |
| 3,126,221 | A | | 3/1964 | Grossman |
| 3,129,024 | A | | 4/1964 | Schuessler |
| 3,297,347 | A | | 1/1967 | Rogers |
| 3,780,904 | A | | 12/1973 | Stanford |
| 3,966,245 | A | | 6/1976 | Losenno |
| 4,286,352 | A | | 9/1981 | Pittasch |
| 4,772,054 | A | | 9/1988 | Schreiber |
| 4,951,984 | A | | 8/1990 | Huang |
| 6,312,026 | B1 | | 11/2001 | Workman |
| 6,370,732 | B1 | | 4/2002 | Yezersky et al. |
| 6,513,193 | B1 | | 2/2003 | Yezersky et al. |
| 6,629,335 | B1 | | 10/2003 | Derman |
| D509,130 | S | | 9/2005 | Amy |
| 6,942,256 | B2 | | 9/2005 | Amy |
| 6,971,687 | B2 | | 12/2005 | Amy |
| 7,111,360 | B1 | | 9/2006 | Hsu |
| 7,226,091 | B2 | | 6/2007 | Amy |
| 7,694,461 | B2 | | 4/2010 | Marocco |
| 8,327,505 | B2 | | 12/2012 | Smith |
| 2007/0040390 | A1 | | 2/2007 | Pilja |
| 2007/0069526 | A1 | | 3/2007 | Hsu |
| 2011/0119865 | A1 | | 5/2011 | Vigeh et al. |
| 2012/0266542 | A1 | | 10/2012 | Graham |

FOREIGN PATENT DOCUMENTS

| | | | |
|---|---|---|---|
| CN | 200810123449 | A | 6/2008 |
| CN | 201193034 | Y | 2/2009 |
| CN | 200920211413 | U | 10/2009 |
| CN | 201521180 | Y | 7/2010 |
| EP | 1983440047 | A | 9/1983 |
| EP | 1993201336 | A | 5/1993 |
| GB | 321378 | A | 2/1929 |
| GB | 395114 | A | 7/1933 |
| GB | 979038 | A | 1/1965 |
| GB | 1092306 | A | 11/1967 |
| GB | 1098721 | A | 1/1968 |
| KR | 19910057556 | Y1 | 7/1991 |
| KR | 100237923 | B1 | 1/2001 |

OTHER PUBLICATIONS

Solid Brass Adjustable Door Catch, Signature Hardware, Erlanger, KY, accessed on the Internet at: http://www.signaturehardware.com/product15219 on Jul. 23, 2013.

Twin Ball Catch 42 mm, SDS London LTD, London, UK, accessed on the Internet at: http://www.sdslondon.co.uk/product/twin-ball-catch-42mm.html on Jul. 23, 2013.

Ball-Nose Spring Plunger with Stainless Steel Ball, McMaster-Carr Supply Company, Santa Fe Springs, CA, Accessed on the Internet at: http://www.mcmaster.com/#3408a59/=nu4ftb on Jul. 29, 2013.

Ives Architectural Hardware Products, Jun. 2009, pp. D8-D9, D13-D16, E6-E9, E14-E19, E21-E22, Ingersoll-Rand Company Limited, US.

* cited by examiner

DOOR CATCH

CROSS REFERENCE

This application is a divisional of U.S. patent application Ser. No. 13/960,308 filed on Aug. 6, 2013. The entire contents of U.S. patent application Ser. No. 13/960,308 are hereby incorporated by reference.

BACKGROUND

The present disclosure relates to door catches, and more particularly door catches utilizing a ball catch mechanism.

Door catches can generally be utilized to hold doors or similar structures in either an open or closed position. In addition, door catches used to hold a door or the like in an open position can be configured to prevent the door from hitting and damaging a wall and therefore can also perform the function of a doorstop.

Door catches come in a variety of different types. For example, roller catches, magnetic catches, hinge pin doorstops, kick down holders, j-hook catches, strike and catch automatic wall holders, and ball catches. One class of door catches relies on tension between two portions of the door catch to hold the door open.

One of the challenges in door catch design, is adjustment of catch tension, particularly for door catches that can be utilized to hold a door in the open position by relying on tension between two portions of the door catch. For example, catch tension adjustment sometimes requires that one of the mounting members be moved relative to the mounting surface. Alternatively, catch tension adjustment may require removal of one of the mounting members from the mounting surface. Either of these can be inconvenient for the installer or maintainer of the door. In many door catch designs, the installer or maintainer is required to drill new holes in order to adjust the position or catch tension. In these designs, micro-adjustments are not possible. Micro-adjustment of catch tension may be particularly important over time, as the door or doorframe shift and settle or as the door sags.

SUMMARY

Doors often sag under their own weight over time. This can damage the hinges or cause the door not to close properly when the door is no longer in alignment with the door opening. This problem is particularly exasperated for heavy or tall residential or commercial doors. The inventor recognized that a door catch could be devised that helps to prevent door sag in addition to solving the problem of providing for micro-adjustments of catch tension while the door catch is mounted to the door.

Disclosed is a door catch that can help to prevent door sag, and provide for post-installation catch tension adjustment without removal or adjustment of mounting members. In one aspect, the door catch includes a ball plunger assembly, a catch bar bracket, and a ball catch base. The ball plunger assembly includes a ball captive within the body of the ball plunger assembly. The exterior of the ball plunger body is threaded. The bottom surface of the ball plunger assembly includes a tool-receiving pattern, such as a slot head, Philips, hex head, or Torx head pattern. The catch bar bracket includes a mounting portion for mounting the catch bar to a door, wall, or doorframe. A catch bar includes a detent on the side facing the ball catch base. The catch bar projects away from the mounting base of the catch bar bracket. The ball catch base also includes a mounting portion for mounting the ball catch base to a door, wall, or wall frame. The ball catch base also includes a base portion that projects away from the ball catch mounting portion. The base portion includes a threaded aperture and the ball plunger assembly is threaded into the threaded aperture with the ball facing and aligned with the detent when the catch is engaged.

The catch bar bracket and the ball catch base are mountable on opposing surfaces of a wall structure and the door so that the ball and detent frictionally engage to hold the door open when the door is in an extended position. The frictional force impinging the ball against the detent is adjustable by rotatably engaging the tool-receiving pattern causing the ball to raise or lower with respect to the detent.

In order to ensure that the door catch can properly sustain the downward force of the door and help keep if from sagging, it is helpful to make sure that door catch components are designed to sustain the force without slippage. One way to help assure this is to provide apertures on the mounting portions that are shaped to hold the fastener in a fixed and non-adjustable position, for example, a recessed aperture with corresponding complementary fastener head.

The catch bar bracket and or corresponding mounting portion in one aspect, can be fabricated from a single piece of metal or otherwise made as a non-separable unit. Alternatively, in another aspect, the catch bar can be separable from the rest of the catch bar bracket. This allows for the possibility of creating a catch bar bracket where the distance between the downward facing detent and its corresponding mounting portion is adjustable.

One example of a catch bar bracket where the distance between the downward facing detent and its corresponding mounting portion is constructed with an integrated base portion projecting away from the mounting portion that includes a serrated top surface. The catch bar includes a serrated bottom surface configured to engage the serrated top surface of the base portion. In combination, they adjust a distance of the detent with respect to the mounting portion of the catch bar bracket. The base portion can include a fastener receiving threaded aperture through the serrated top surface and the catch bar bracket, a slot for receiving and securing a threaded fastener to the fastener receiving threaded aperture.

Another aspect of the disclosed door catch that allow for distance adjustment of the detent with respect to the catch bar mounting portion separates the catch bar bracket into a mounting portion and a catch bumper portion where the catch bumper portion includes the downward facing detent. The two portions are separated by a rod. If the rod is threaded, the distance between the catch bumper portion and the mounting portion may be adjusted by screwing the threaded rod into the mounting portion or the bumper portion. Alternatively the rod may allow for distance adjustment by a securing a pin between the bumper portion or the mounting portion and one of several holes mounted at various distances along the rod.

In another aspect, the disclosed door catch can be adapted to work on a pivot door. In this aspect, the catch bar is formed in the shape of a downward facing L-bracket and the mounting portion of the catch bar bracket is configured as a planar back with respect to the downward facing L-bracket.

This Summary has introduced a selection of concepts in simplified form that are described the Description. The Summary is not intended to identify essential features or limit the scope of the claimed subject matter.

DRAWINGS

DESCRIPTION

Figure 1:
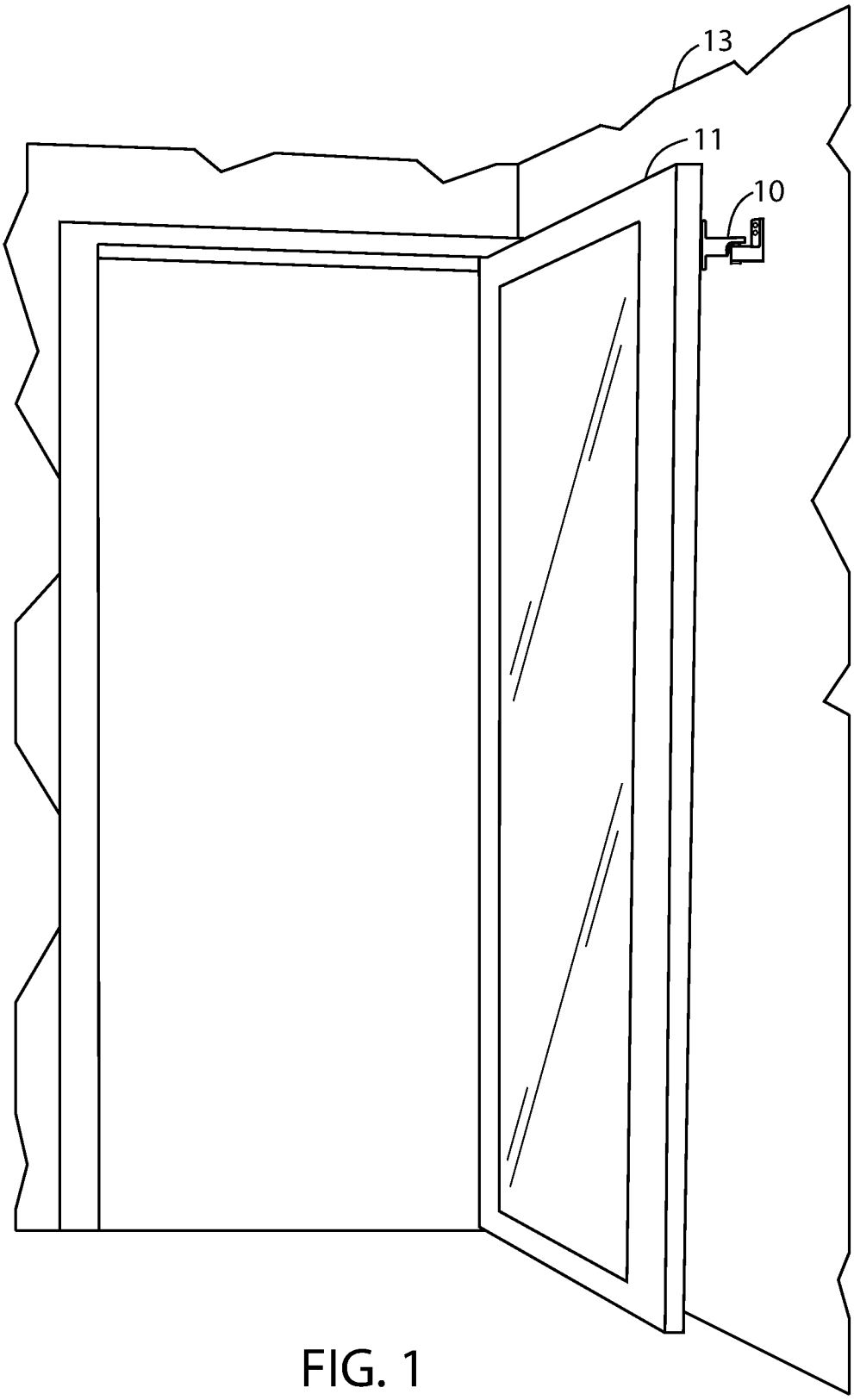
FIG. 1 shows a door catch of the present disclosure mounted near the top of a door and corresponding wall.
Figure 2:
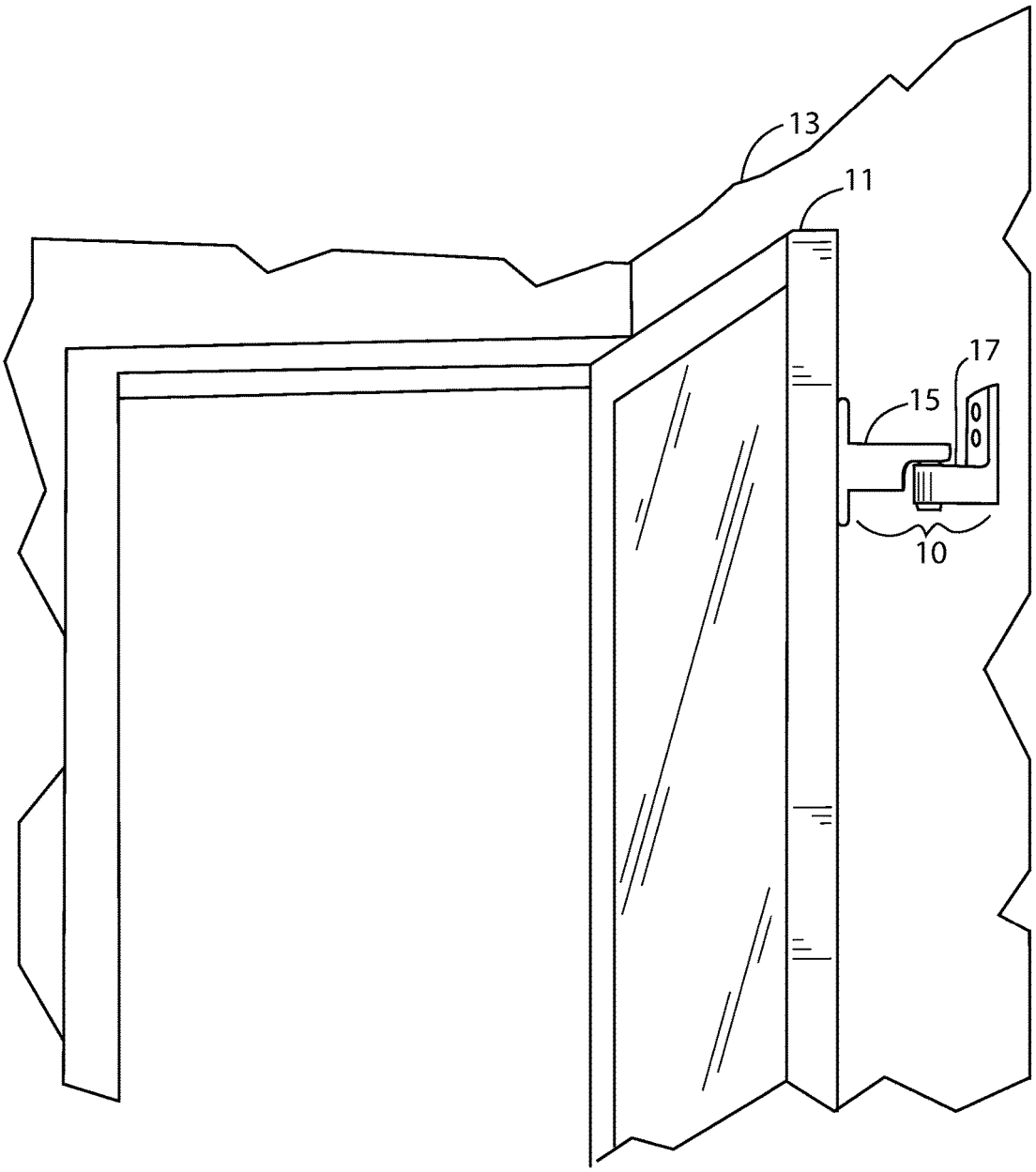
FIG. 2 shows a portion of FIG. 1 detailing the door catch in relation to the door and corresponding wall.
Figure 3:
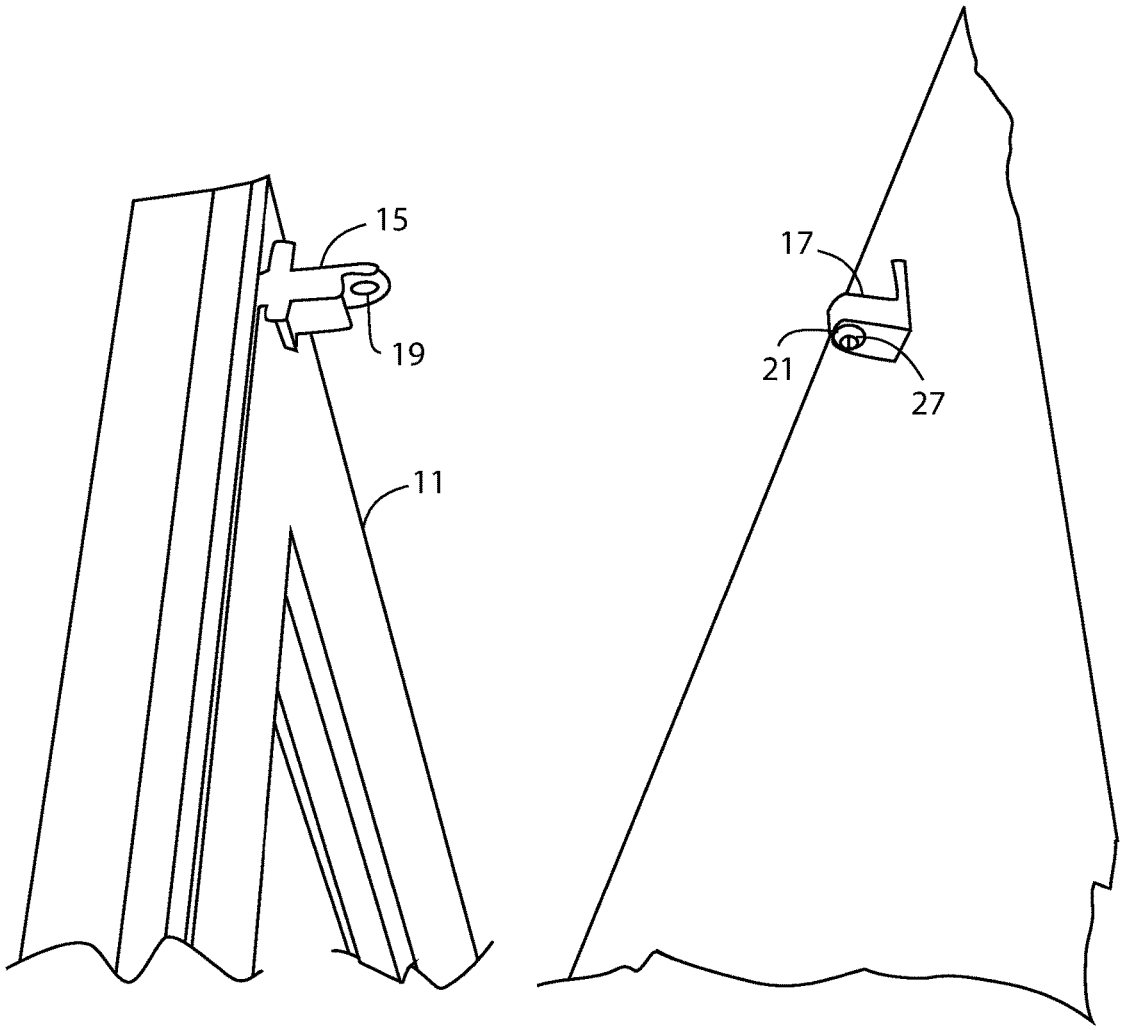
FIG. 3 shows a portion of the door and frame in the open position of FIG. 1 with corresponding door catch.

The following description is made with reference to figures, where like numerals refer to like elements throughout the several views, FIG. 1 shows a door catch 10 of the present disclosure mounted near the top of a door 11 and corresponding wall 13. FIG. 2 shows a portion of FIG. 1 detailing the door catch 10 in relation to the door 11 and corresponding wall 13. FIG. 3 shows a portion of the door 11 in the open position where the catch portions are separate and not engaged. Referring to FIGS. 2-3, the door catch 10 of FIG. 2 includes a catch bar bracket 15 secured to the door and a ball catch base 17 secured to the wall. Referring to FIG. 3, the catch bar bracket 15 includes a detent 19 in the lower surface of the catch bar portion of the catch bar bracket 15. The door catch 10 holds the door 11 in place through friction. When the door 11 is in the fully open position, the detent 19 aligns a ball plunger assembly 21 in order to create a friction force that holds the door open. One of the utilities of the door catch 10 of this disclosure is the ability to adjust the frictional force that holds the door in place without removing or moving the catch bar bracket 15 or ball catch base 17. The friction between the ball plunger assembly 21 and the detent 19 can be adjusted by moving the ball plunger assembly 21 up and down relative to the top of the ball catch base 17. The ball plunger assembly 21 is shown from the bottom with a slot 27 for engaging a screwdriver or similar tool for adjusting the height of the ball plunger assembly 21 relative to the ball catch base 17.

In FIGS. 1-3, the catch bar bracket 15 and ball catch base 17 are shown as mounted between a door 11 and a wall 13. It should be understood by the reader, that in FIGS. 1-3, and throughout this disclosure, that the catch bar bracket 15 and ball catch base 17 can be mounted between the door 11 and other mounting surfaces that can be intersected by a door when open; for example, a folding door panel.

Figure 4:
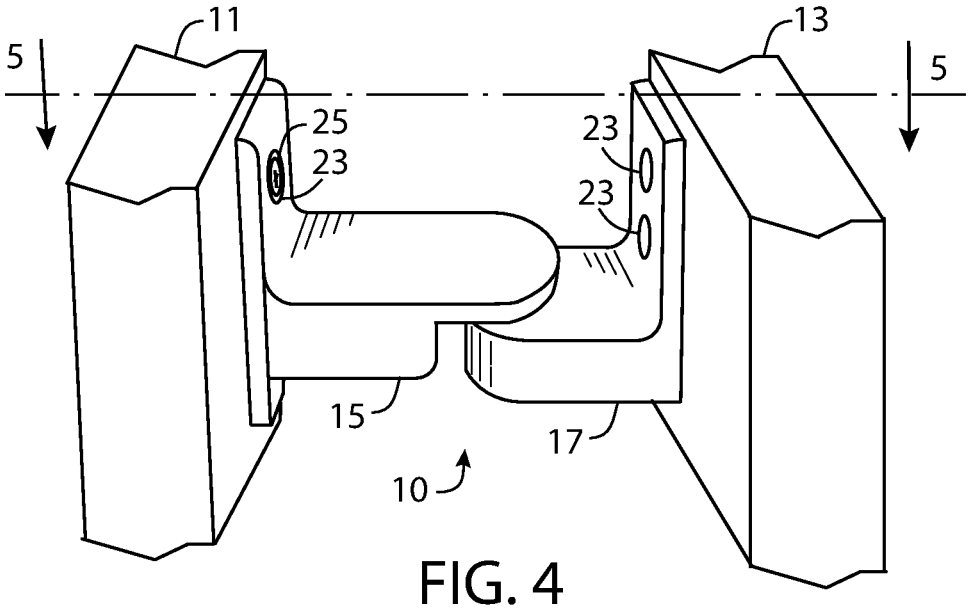
FIG. 4 shows the door catch of FIG. 1 in top perspective view.
Figure 5:
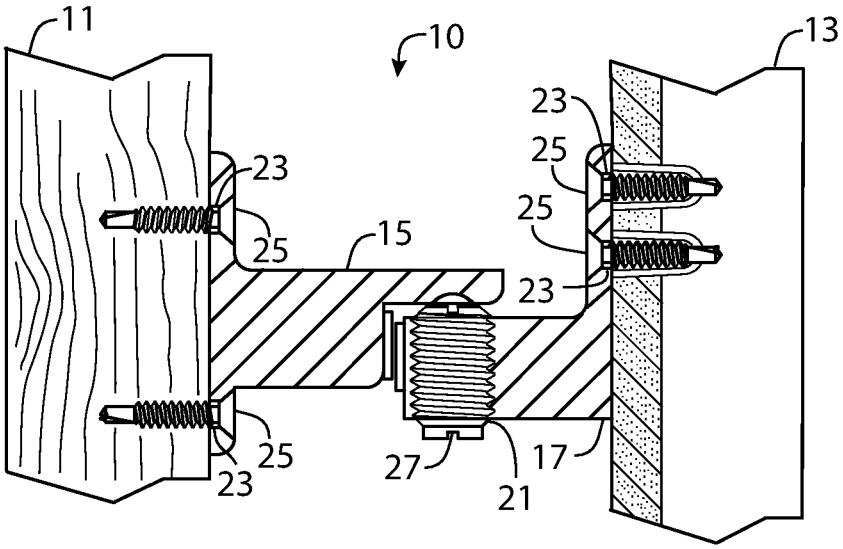
FIG. 5 shows a sectional view of the door catch of FIG. 4 shown along section lines 5-5.

FIG. 4 shows the door catch 10 of FIG. 1 in top perspective view showing the relationship between the catch bar bracket 15 and the ball catch base 17 when frictionally engaged; for example, when the door 11 is open and proximate to the wall 13. FIG. 5 shows a sectional view of the door catch 10 of FIG. 4 shown along section lines 5-5. Referring to FIGS. 4-5, the catch bar bracket 15 and ball catch base 17 are secured respectively to the door 11 and wall 13 by apertures 23 and corresponding threaded fasteners 25 through the apertures 23 through the surface of the catch bar bracket 15 and the ball catch base 17. The catch bar bracket 15 and the ball catch base 17 need to be mounted in a way to withstand the rotational torque of the door 11 with respect to its hinges in order prevent the door 11 from sagging over time. One way to assure this is to provide mounting holes where the fastener is mounted in fixed mounting holes without any possibility for vertical or horizontal movement within the hole. As an example, the apertures 23 in FIGS. 4-5 are round and countersunk.

In FIG. 5, the ball plunger assembly 21 is shown threaded into the ball catch base 17 and can be rotated to increase or decrease friction between the ball plunger assembly 21 and the catch bar bracket 15. A slot 27 is provided to engage a screwdriver or other similar tool. When the ball plunger assembly 21 is rotated upward into the ball catch base, the friction between the ball plunger assembly 21 and the catch bar bracket 15 is increased. As the ball plunger assembly 21 is rotated downward out of the ball catch base, the friction between the ball plunger assembly 21 and the catch bar bracket 15 is decreased.

The door 11 is illustrated in FIG. 5 as being made of wood. The wall 13 is illustrated as having a drywall outer surface with the threaded fasteners 25 engaging drywall anchors or the like. The door catch 10 can be mounted on most common commercial or residential door materials. For example, the door material can be steel, steel over foam core, metal, wood, or fiberglass framed-glass.

Figure 6:
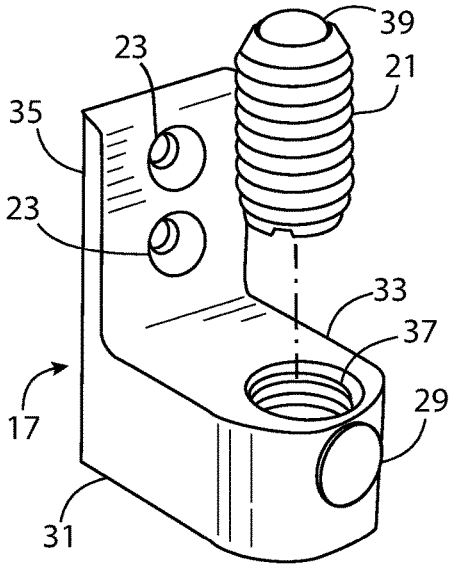
FIG. 6 shows a top perspective exploded view of the ball catch base and the ball plunger of the door catch of FIG. 4.
Figure 7:
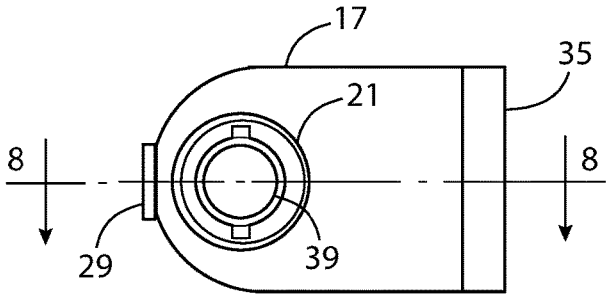
FIG. 7 shows a top assembled view of the ball catch base and ball plunger assembly of FIG. 6.
Figure 8:
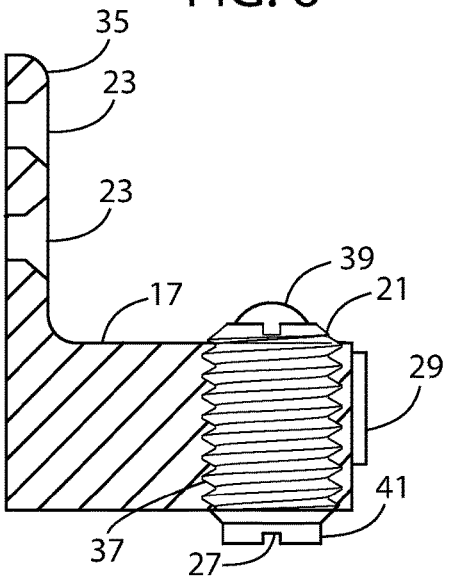
FIG. 8 shows a sectional view of the FIG. 7 shown along section lines 8-8.
Figure 9:
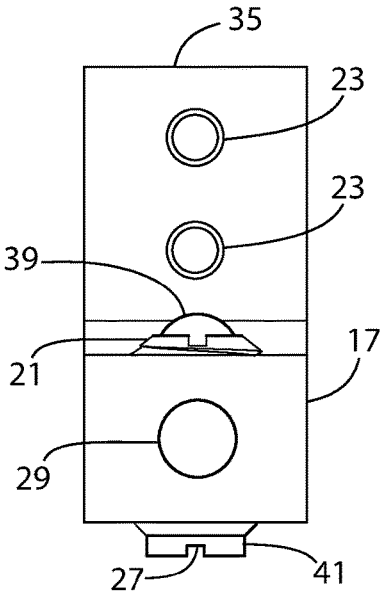
FIG. 9 shows a front view of the ball catch base and ball plunger assembly of FIG. 7.
Figure 10:
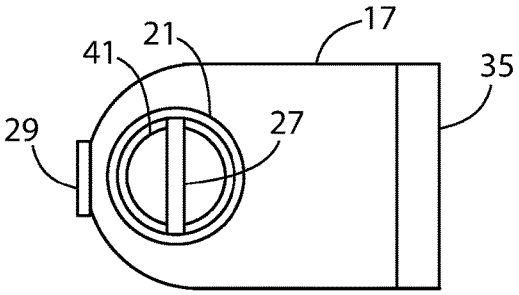
FIG. 10 shows a bottom view of the ball catch base and ball plunger assembly of FIG. 7.

FIG. 6 shows a top perspective exploded view of the ball catch base 17 and the ball plunger assembly 21 of the door catch of FIG. 4. FIG. 7 shows a top assembled view of the ball catch base 17 and ball plunger assembly 21 of FIG. 6. FIG. 8 shows a sectional view of the FIG. 7 shown along section lines 8-8. FIG. 9 shows a front view of the ball catch base 17 and ball plunger assembly 21 of FIG. 7. FIG. 10 shows a bottom view of the ball catch base 17 and ball plunger assembly 21 of FIG. 7. Referring to FIGS. 6-10, a bumper 29 is shown optionally attached to the ball catch base 17. Depending on the whether the ball catch base 17 is secured to the door 11, wall 13 of FIG. 1 for example, or a doorframe, the bumper 29 can be used to protect the opposing surface from damage. The bumper 29 can be made generally of a pliant material such a soft plastic or an elastomer such as silicone rubber or butyl rubber. Those skilled in the art will readily recognize materials suitable for the bumper 29.

Referring to FIG. 6, the ball catch base 17 is illustrated in the shape of a bracket. The ball catch base 17 includes a base portion 31 that when mounted to a wall or door projects approximately perpendicularly away from the door. If the door is mounted vertically, as in the door 11 illustrated in FIGS. 1-3, then a top surface 33 of the base portion 31 lies substantially in the horizontal plane. The ball catch base 17 includes a mounting portion 35 that lies in the same plane as the mounting surface of the door, wall, or doorframe. The mounting portion 35 projects approximately perpendicularly away from the plane of the top surface 33 of the base portion 31 of the ball catch base 17. While the mounting portion 35 is shown projecting upward from the base portion 31, the mounting portion 35 can optionally be constructed to project both upward and downward with respect to the base portion 31 for additional support.

FIGS. 6-10 all show the mounting portion 35 in various views. FIGS. 6, 8, and 9 show the apertures 23 for mounting the ball catch base 17 to the wall or door in relation to the mounting portion 35. FIGS. 6 and 8 shows the apertures 23 as countersunk. As previously described, the aperture 23 is shaped so that threaded fastener 25 of FIGS. 4-5 is fixed in position without the opportunity to slide or move under the downward torque of the open door.

FIG. 6 shows a threaded aperture 37 sized and threaded to receive the ball plunger assembly 21. FIG. 8 shows the ball plunger assembly 21 threaded inside the threaded aperture 37. The ball plunger assembly 21 can be moved up and down with respect to the top surface 33 of the base portion 31 of the ball catch base 17 by rotationally engaging the slot 27 with a screwdriver or similar tool. Referring to FIGS. 6-9, the ball plunger assembly 21 includes a tension ball 39. Referring to FIGS. 8-10, the ball plunger assembly 21 includes a tool-engaging plunger base 41 with a slot 27 or other shape for engaging a tool in rotational motion.

Figure 11:
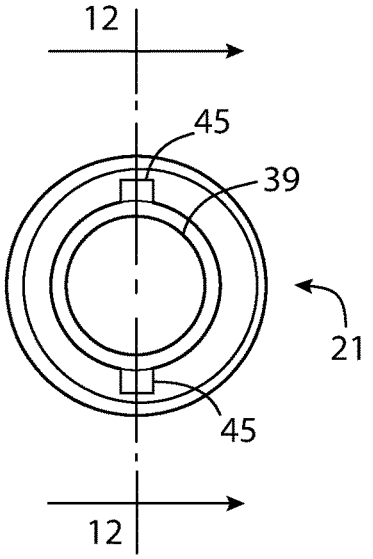
FIG. 11 shows the ball plunger assembly of the door catch of FIG. 4 in top view.
Figure 12:
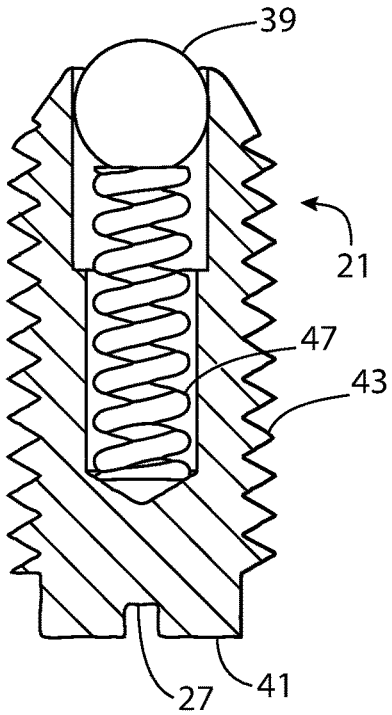
FIG. 12 shows a cross sectional view of the ball plunger assembly of FIG. 11 taken along section lines 12-12.
Figure 13:
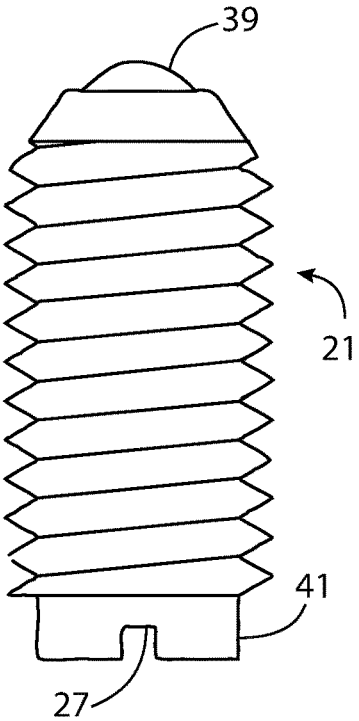
FIG. 13 shows a side view of the ball plunger assembly of the door catch of FIG. 4.
Figure 14:
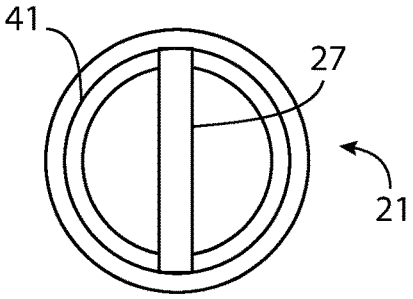
FIG. 14 shows a bottom view of the ball plunger assembly from the door catch of FIG. 4.

FIG. 11 shows, in top view, the ball plunger assembly 21 of the door catch 10 of FIG. 4. FIG. 12 shows a cross sectional view of the ball plunger assembly 21 of FIG. 11 taken along section lines 12-12. FIG. 13 shows a side view of the ball plunger assembly 21. FIG. 14 shows a bottom view of the ball plunger assembly 21. FIGS. 11-13 show the tension ball 39. The tension ball 39 is shown in cross section in FIG. 12. The tension ball 39 generally has a circular profile or spherical shape. Other shapes can be used to produce specific frictional profiles. For example, an elliptical shape with the top of the tension ball 39 along the major axis of the elliptical shape, assuming uniform deformation of the tension ball 39, the force at the point of contact with the detent 19 of FIG. 3 would tend to be concentrated over less of an area than a tension ball 39 that is spherically shaped. The door would tend to release more abruptly as the force of friction would be overcome over less surface area than the tension ball 39 of spherical shape. Similarly, an elliptical shape with the top of the tension ball 39 along the minor axis of the elliptical shape, assuming uniform deformation of the tension ball 39, would tend to release less abruptly than a tension ball 39 with a corresponding spherical shape.

FIG. 12 shows the internal construction of ball plunger assembly 21 including the tension ball 39, the threaded ball plunger body 43, tool-engaging plunger base 41, and the slot 27. The ball plunger assembly 21 is similar in construction to spring plungers used in the art for positioning fixtures, punch presses, or forging dies. The tension ball 39 is typically installed through the top opening using a plunger wrench. The plunger wrench typically includes projections that are complementary to rectangular insertion points 45 shown in FIG. 11.

Referring again to FIG. 12, the ball plunger assembly 21 includes a spring 47. The spring provides compression force, and thereby holding friction, when the tension ball 39 makes contact with the detent 19 of FIG. 3. In FIGS. 13-14, the ball plunger assembly 21, when rotated, moves linearly as an integrated unit within the threaded aperture 37 of ball catch base 17 of FIG. 6. The slot 27 of the tool-engaging plunger base 41 is a typical tool-engaging screw drive. Alternatively, other tool-engaging screw drives may be used, for example, Phillips, Frearson, Cross, Robertson (square shaped), Allen (hex shaped), Torx, or TTAP, as long as they are able to engage the ball plunger assembly 21 with sufficient force and grip to prevent stripping.

Figure 15:
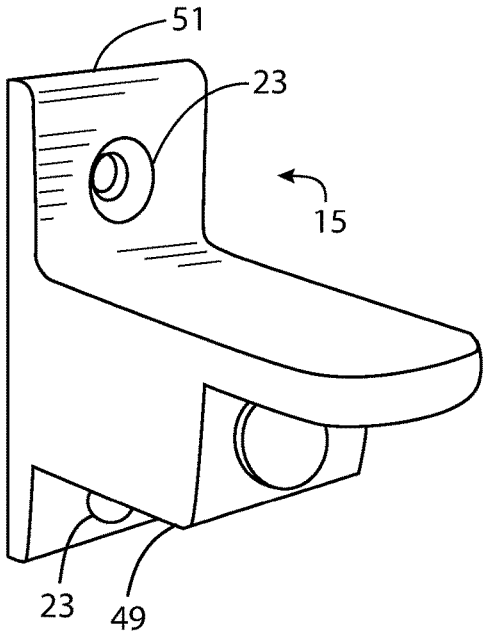
FIG. 15 shows a front top perspective view of the catch bar bracket of the door catch of FIG. 4.
Figure 17:
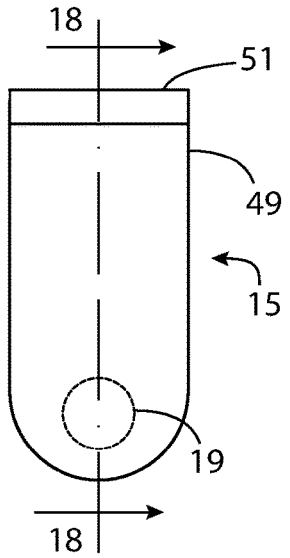
FIG. 17 shows a top view of the catch bar bracket of FIG. 15.
Figure 16:
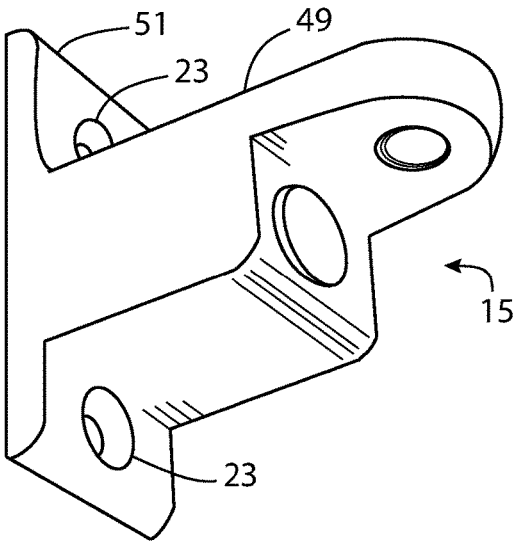
FIG. 16 shows a front bottom perspective view of the catch bar bracket of FIG. 15.
Figure 18:
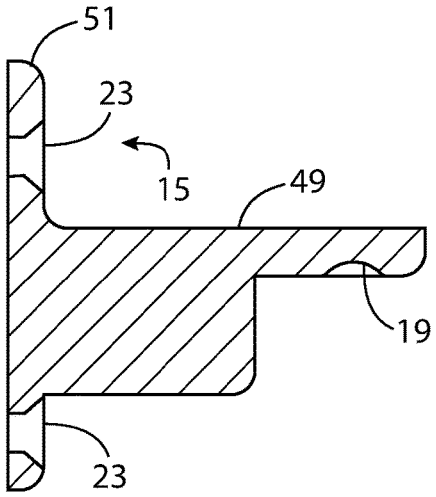
FIG. 18 shows a sectional view of FIG. 17 taken along section lines 18-18.

FIG. 15 shows a front top perspective view of the catch bar bracket 15 of the door catch 10 of FIG. 4. FIG. 16 shows a front bottom perspective view of the catch bar bracket 15. FIG. 17 shows a top view of the catch bar bracket 15. FIG. 18 shows a sectional view the catch bar bracket 15 of FIG. 17 taken along section lines 18-18. Referring to FIGS. 15-18, the catch bar bracket 15 includes an integrated catch bar/base 49 and a mounting portion 51. The mounting portion 51 projects approximately perpendicularly away from integrated catch bar/base 49. In FIGS. 15-16 and 18, the mounting portion 51 is shown projecting perpendicularly away from both above and below both the integrated catch bar/base 49. With a typical vertically mounted door, wall, and doorframe, the mounting portion 51 would be oriented vertically and the integrated catch bar/base 49 would be projecting horizontally away from the door. The mounting portion 51 includes apertures 23. The apertures 23 of the catch bar bracket 15 are round and countersunk to prevent any possibility of vertical or horizontal movement within the hole so as to withstand the rotational torque of the door 11 with respect to its hinges in order prevent the door 11 from sagging over time as previously described.

FIGS. 17 and 18 show the detent 19 for frictionally engaging the tension ball 39 of FIGS. 11-14. The detent 19 is shown having a circular profile that is complementary to the spherical shape of the tension ball 39 of FIGS. 11-14. Other arcuate shapes can be used to adjust the frictional force of engagement or disengagement. For example, given the same spherically shaped tension ball, an elliptical shaped with the center line along its minor axis would tend to more gradually disengage and engage but potentially provide a weaker frictional holding force than a comparable spherical shaped detent.

Figure 19:
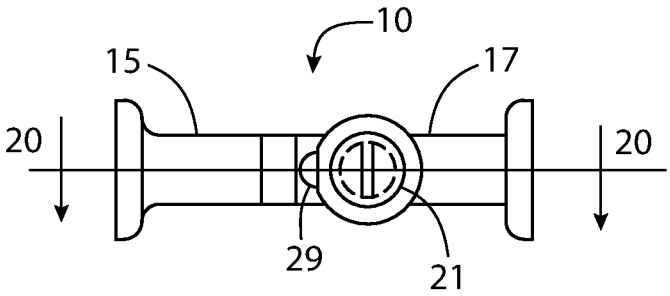
FIG. 19 shows a top view of a door catch with alternative catch bar bracket and alternative ball catch base construction.
Figure 20:
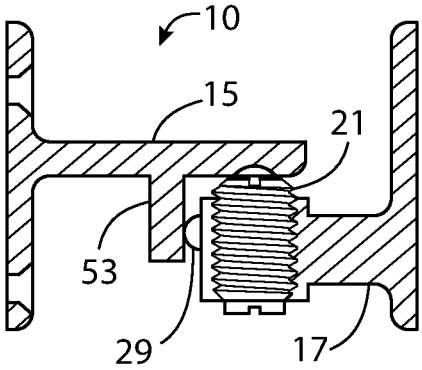
FIG. 20 shows a sectional view of the catch bar bracket of FIG. 19 taken along section lines 20-20.

FIG. 19 shows a top view of a door catch 10 with alternative construction of the catch bar bracket 15 and alternative construction of the ball catch base 17. FIG. 20 shows a sectional view of the door catch 10 of FIG. 19 taken along section lines 20-20. FIGS. 19-20 show the alternatively constructed versions of the catch bar bracket 15, ball catch base 17, the ball plunger assembly 21, and an alternatively shaped version of the bumper 29, in engaged cooperation as previously described. A catch stop 53 projects downward from the catch bar bracket 15 and functions to horizontally limit the motion of the ball catch base 17 when frictionally engaged with the catch bar bracket 15. The bumper 29, here shown as hemi-spherically shaped, dampens the force between the catch stop 53 and the ball catch base 17.

Figure 21:
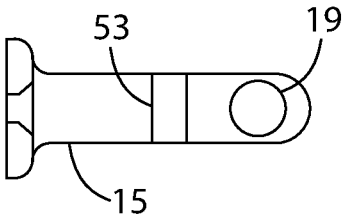
FIG. 21 shows a bottom view of the catch bar bracket of FIG. 19.
Figure 22:
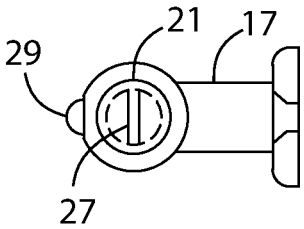
FIG. 22 shows a bottom view of the ball catch base of FIG. 19.

FIG. 21 shows a bottom view of the catch bar bracket 15 of FIG. 19. FIG. 22 shows a bottom view of the ball catch base 17 of FIG. 19. FIG. 21 shows in the detent 19 and the catch stop 53. FIG. 22 shows bumper 29 and the bottom of the ball plunger assembly 21. The ball plunger assembly 21 is shown with the slot 27 for rotationally engaging the ball plunger assembly 21, as previously described.

Figure 23:
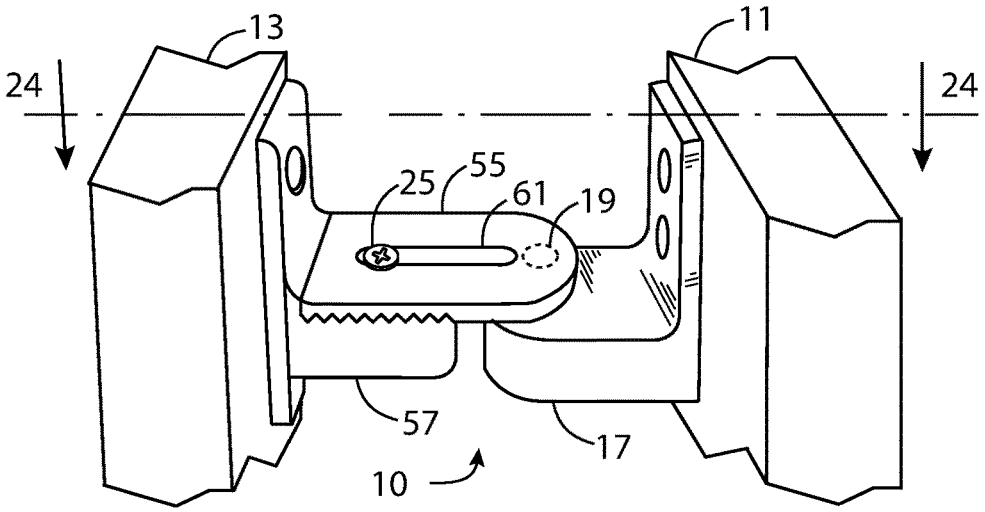
FIG. 23 shows a top perspective view of a door catch with an alternative catch bar bracket and catch bar base where the position of the catch bar detent from the wall or doorframe is adjustable.
Figure 24:
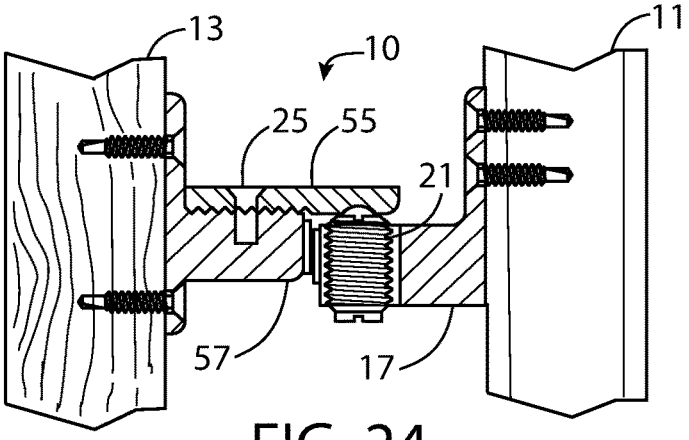
FIG. 24 shows a cross sectional view of the door catch of FIG. 23 taken along section lines 24-24.
Figure 25:
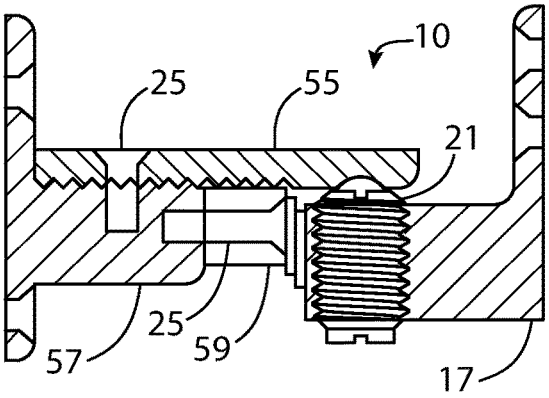
FIG. 25 shows a cross sectional view of the door catch of FIG. 23 taken along section lines 24-24 with an optional spacer.
Figure 26:
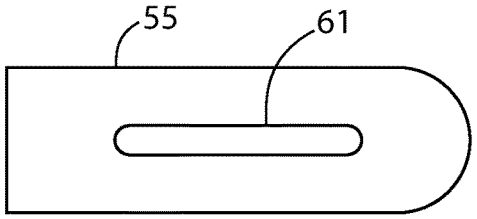
FIG. 26 shows a top view of the catch bar of FIG. 23.
Figure 27:
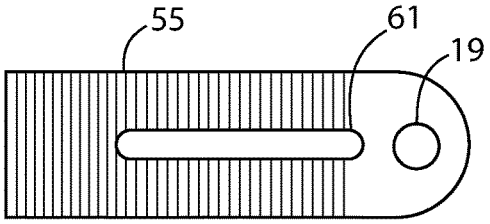
FIG. 27 shows a bottom view of the catch bar of FIG. 23.
Figure 28:
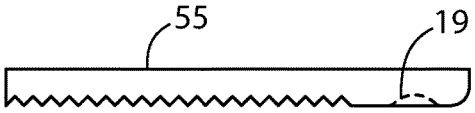
FIG. 28 shows a side view of the catch bar of FIG. 23.
Figure 29:
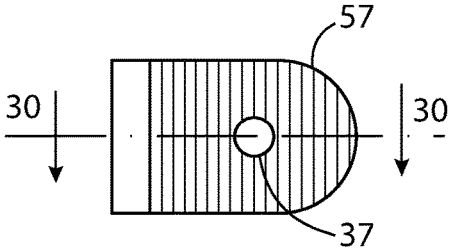
FIG. 29 shows a top view of the catch bar base of FIG. 23.
Figure 31:
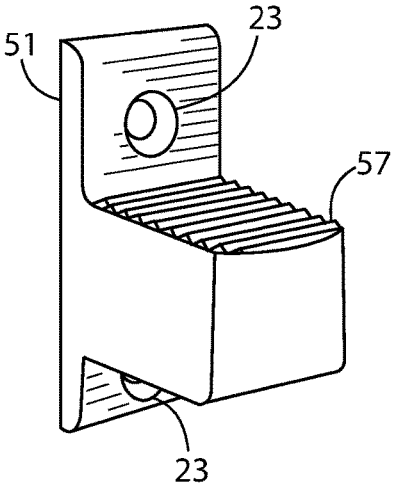
FIG. 31 shows a top perspective view of the catch bar base of FIG. 29.
Figure 30:
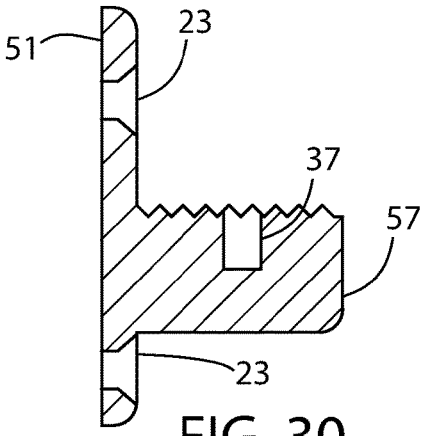
FIG. 30 shows a sectional view of FIG. 29 taken along section lines 30-30.

FIGS. 23-38 show several configurations of door catches 10 where the catch bar is horizontally adjustable with respect to its mounting surface. This may be desirable when a specific distance between the open door and wall needs to be maintained. FIGS. 23-31 illustrate horizontal adjustment using a serrated catch bar and catch bar base with complementary serrations. FIG. 23 shows a top perspective view of a door catch with a catch bar 55 and catch bar base 57 where the position of the detent 19 from the wall 13 or doorframe is adjustable. The ball catch base is shown secured to a door 11. The detent 19 is shown in hidden lines. FIG. 24 shows a cross sectional view of the door catch 10 of FIG. 23 taken along section lines 24-24 with the catch bar base secured to the wall 13 and the ball catch base secured to the door 11. The door 11 is illustrated as having a fiberglass or metal frame, and the wall including a wood member. As previously described, the door catch 10 can be mounted to most common residential door and wall materials. FIG. 25 shows a cross sectional view of the door catch 10 of FIG. 23 taken along section lines 24-24 with a spacer 59. FIG. 26 shows a top view of the catch bar 55 of FIG. 23. FIG. 27 shows a bottom view of the catch bar 55 of FIG. 23. FIG. 28 shows a side view of the catch bar 55 of FIG. 23. FIG. 29 shows a top view of the catch bar base 57 of FIG. 23. FIG. 30 shows a sectional view of the catch bar base 57 of FIG. 29 taken along section lines 30-30. FIG. 31 shows a top perspective view of the catch bar base 57 of FIG. 29.

Referring to FIG. 23, the door catch 10 includes the ball catch base 17 previously described for FIGS. 6-10, the catch bar 55 and catch bar base 57. Referring to FIGS. 27-28, the catch bar 55 includes a detent 19 that frictionally engages the ball plunger assembly 21; the ball plunger assembly 21 is illustrated frictionally engaging the catch bar 55 in FIGS. 24-25. The force of friction between the ball plunger assembly 21 and the catch bar 55 is adjustable by rotationally engaging the ball plunger assembly 21 causing it to move up or down depending on the direction of rotation as previously described. The distance between the catch bar base 57 and the ball catch base 17 can be adjusted by extending the catch bar 55 along the catch bar base 57. A slot 61, shown in FIGS. 23, and 26-27, can adjustably secure the position of the catch bar 55 relative to the catch bar base 57. Complementary serrations on the bottom surface of the catch bar 55, shown in FIGS. 23-25, and 27-28, and the catch bar base 57, shown in FIGS. 23-25, and 29-31 ensure that the when secured, slippage may not occur between the catch bar 55 and catch bar base 57 under the forces exerted by the door. The threaded fastener 25 is illustrated in FIGS. 23-25. FIGS. 29-30 show the threaded aperture 37 for receiving the threaded fastener 25.

The catch bar 55 of FIGS. 23-28 can be manufactured in different standard lengths to accommodate various distance ranges between the door and wall/doorframe. Alternatively, a universal catch bar can be supplied that can be designed to be cut to length to accommodate a specific installation requirement. In FIG. 25 a spacer 59 secured to the front of the catch bar base 57 to provide a bumper surface between the catch bar base 57 and the ball catch base 17. The spacer 59 is shown secured to the catch bar base 57 by a threaded fastener 25. The spacer 59 can similarly be secured by a spring-loaded snap fit fastener.

FIGS. 30-31 show the mounting portions 51 projecting perpendicularly upwardly and downwardly away from the horizontal plane of the catch bar base 57. As previously discussed, the mounting portion 51 includes apertures 23. The apertures 23 of the catch bar bracket 15 are round and countersunk to prevent any possibility of vertical or horizontal movement within the hole so as to withstand the rotational torque of the door with respect to its hinges in order prevent the door from sagging over time as previously discussed.

Figure 32:
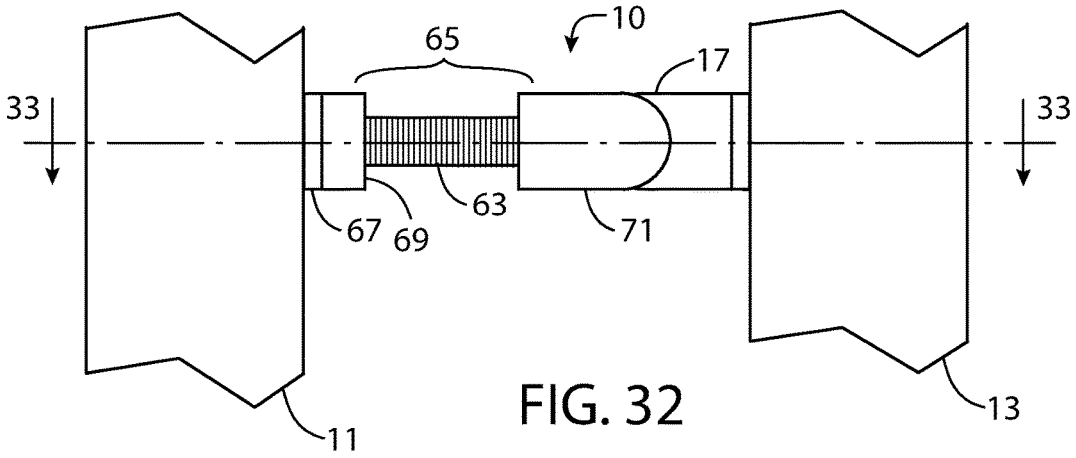
FIG. 32 shows a top view of an alternative door catch where the position of the catch bar detent from the wall or doorframe is adjustable by a threaded rod.
Figure 33:
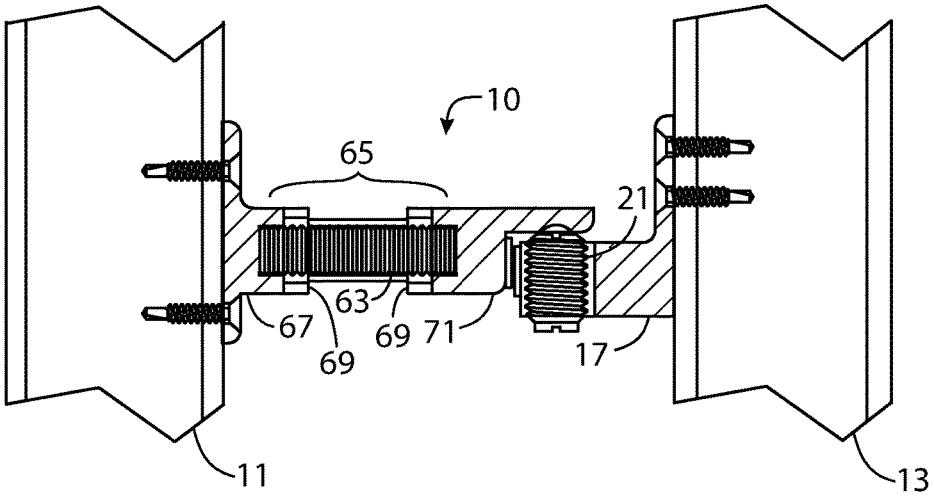
FIG. 33 shows a sectional view of FIG. 32 taken along section lines 32-32.
Figure 34:
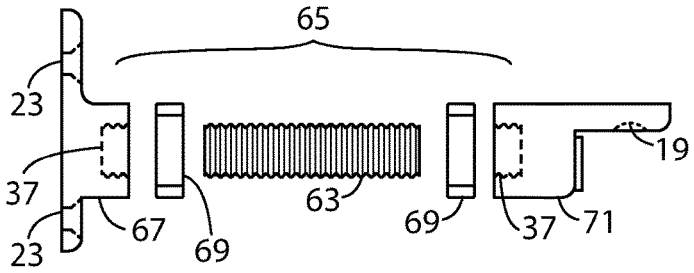
FIG. 34 shows a side exploded view of catch bar assembly of FIG. 32.

FIG. 32 shows a top view of the door catch 10 alternatively constructed where the position of the detent from the door 11 or alternatively the wall is adjustable by a threaded rod 63. FIG. 33 shows a sectional view of FIG. 32 taken along section lines 32-32 showing the door catch assembly in the catch position between the door 11 and wall 13. FIG. 34 shows a side exploded view of catch bar assembly 65 of FIG. 32 showing the detent 19 in broken lines representing hidden lines. Referring to FIGS. 32-34, the catch bar assembly 65 includes the threaded rod 63, a mounting base 67, jamb nut 69, and a catch bumper 71. Referring to FIG. 34, the mounting base 67 and the catch bumper 71 include a threaded aperture 37 for receiving the threaded rod 63. The jamb nut 69 locks the threaded rod 63 in place once the distance is adjusted. The threaded rod 63 can come in a variety of standard lengths to accommodate specified distances between the door 11 and wall 13 of FIGS. 32-33. Optionally, a universal length version of the threaded rod 63 can provided and cut to length by the door installer. The ball catch base 17 of FIGS. 32-33 and the ball plunger assembly 21 of FIG. 33 can be the same ball catch base 17 and ball plunger assembly 21 as previously described in FIGS. 6-10. The apertures 23 of the mounting base 67 are round and countersunk to prevent any possibility of vertical or horizontal movement within the hole so as to withstand the rotational torque of the door with respect to its hinges in order prevent the door from sagging over time as previously discussed.

Figure 35:
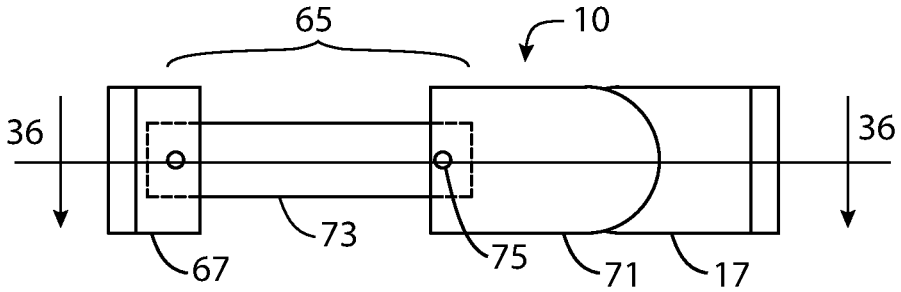
FIG. 35 shows a top view of an alternative door catch where the position of the catch bar detent from the wall or doorframe is adjustable by a rod and pin arrangement.
Figure 36:
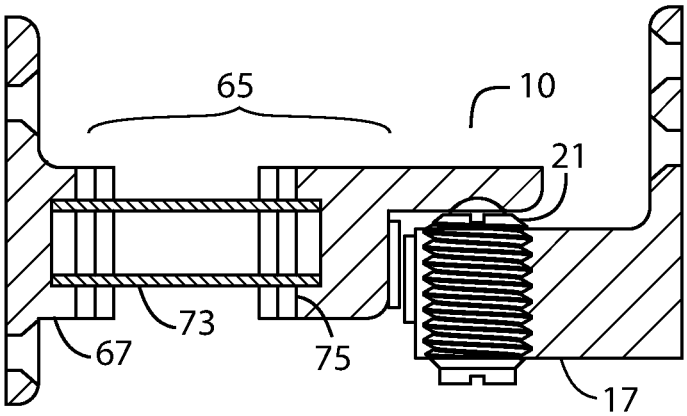
FIG. 36 shows a sectional view of FIG. 32 taken along section lines 36-36.
Figure 37:
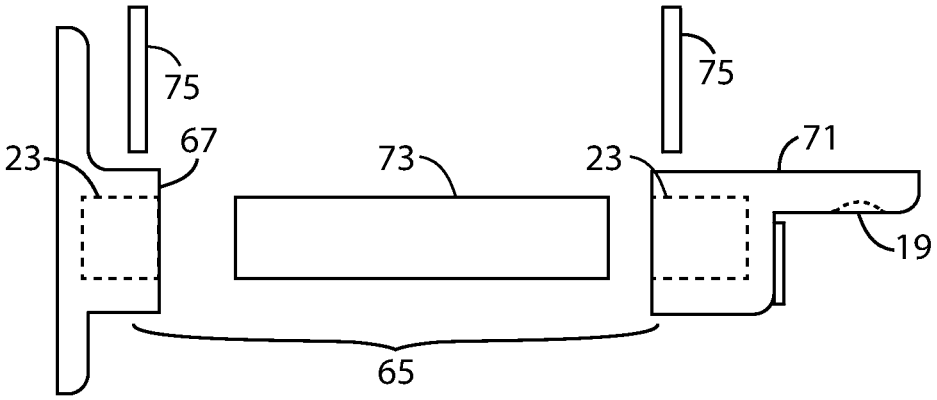
FIG. 37 shows a side exploded view of the catch bar assembly of FIG. 35.
Figure 38:
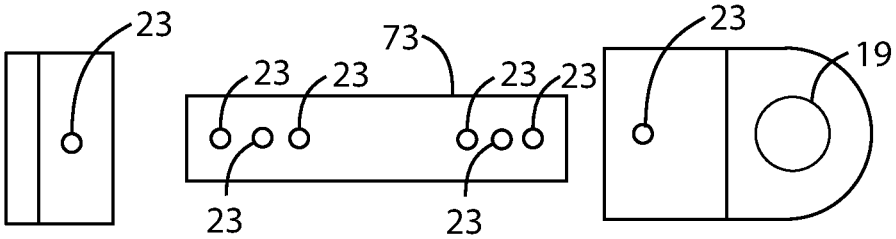
FIG. 38 shows a bottom exploded view of the catch bar assembly of FIG. 35.

FIG. 35 shows a top view of the door catch 10 of alternative construction where the position of the catch bar detent from the wall or doorframe is adjustable by a rod and pin arrangement. FIG. 36 shows a sectional view of the door catch 10 of FIG. 32 taken along section lines 36-36. FIG. 37 shows a side exploded view of the catch bar assembly 65 of FIG. 35. FIG. 38 shows a bottom exploded view of the catch bar assembly 65 of FIG. 35 showing the detent 19. Referring to FIGS. 35-37, the catch bar assembly 65 includes a non-threaded rod 73, a mounting base 67, holding pins 75, and a catch bumper 71. Referring to FIG. 37, the mounting base 67 and the catch bumper 71 each include an aperture 23 for receiving the non-threaded rod 73. Each of the apertures 23 is indicated by broken lines. FIG. 38 shows a series of apertures 23 in the non-threaded rod 73 and a corresponding apertures 23 in the mounting base 67 and the catch bumper 71 for receiving the holding pin 75 of FIG. 37. In FIG. 36, the holding pins 75 are inserted in place in the non-threaded rod 73 once the distance is adjusted. The non-threaded rod 73 of FIGS. 35-38 can come in a variety of standard lengths to accommodate specified distances between the door and the wall. Optionally, a universal length version of the non-threaded rod 73 can provided and cut to length by the door installer. The ball catch base 17 of FIGS. 35-36 and the ball plunger assembly 21 of FIG. 36 can be the same ball catch base 17 and ball plunger assembly 21 as previously described in FIGS. 6-10. The apertures 23 of the mounting base 67 are round and countersunk to prevent any possibility of vertical or horizontal movement within the hole so as to withstand the rotational torque of the door with respect to its hinges in order prevent the door from sagging over time as previously discussed.

Figure 39:
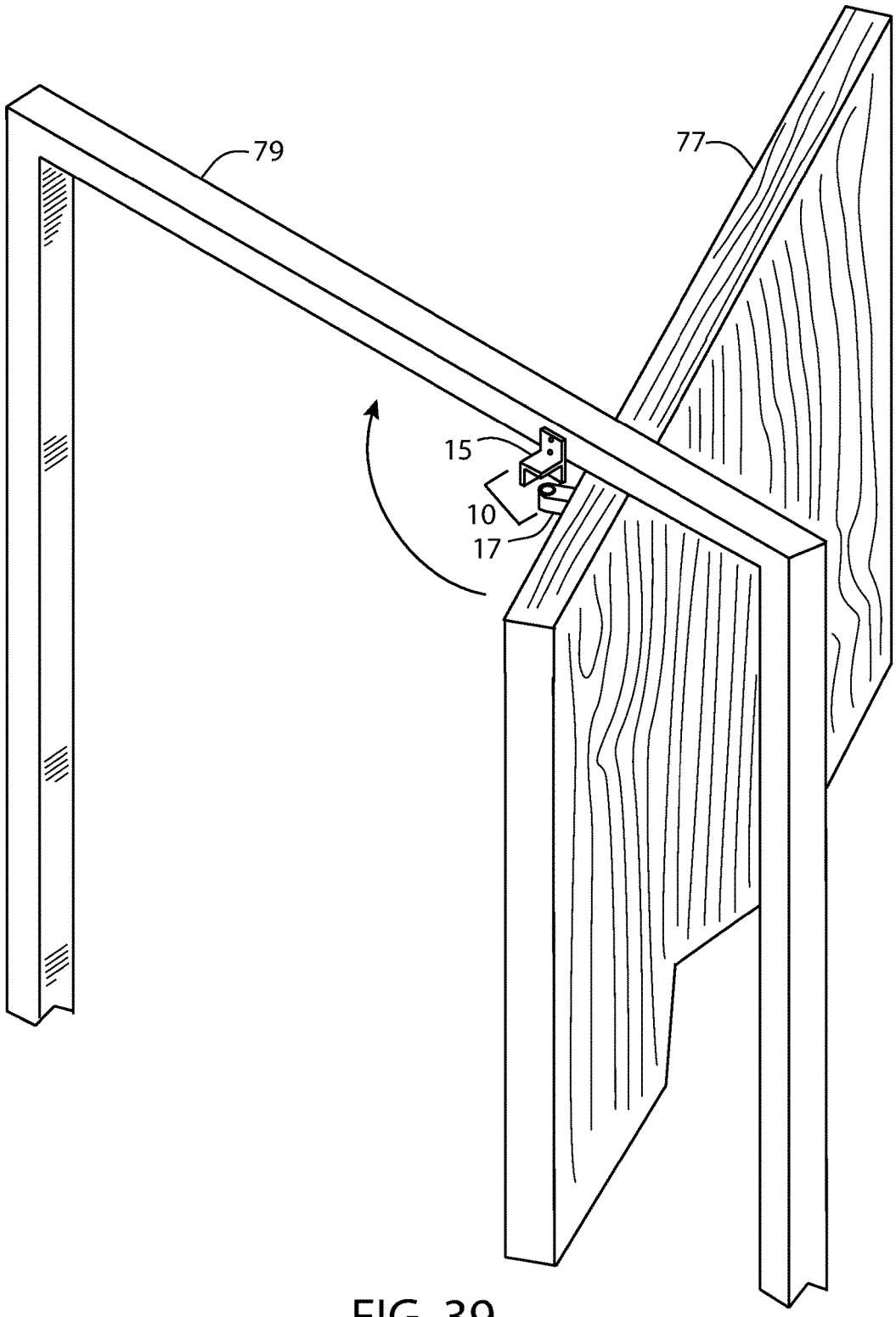
FIG. 39 shows an upper portion of a partially open pivot door in top front perspective view illustrating an alternative door catch.
Figure 40:
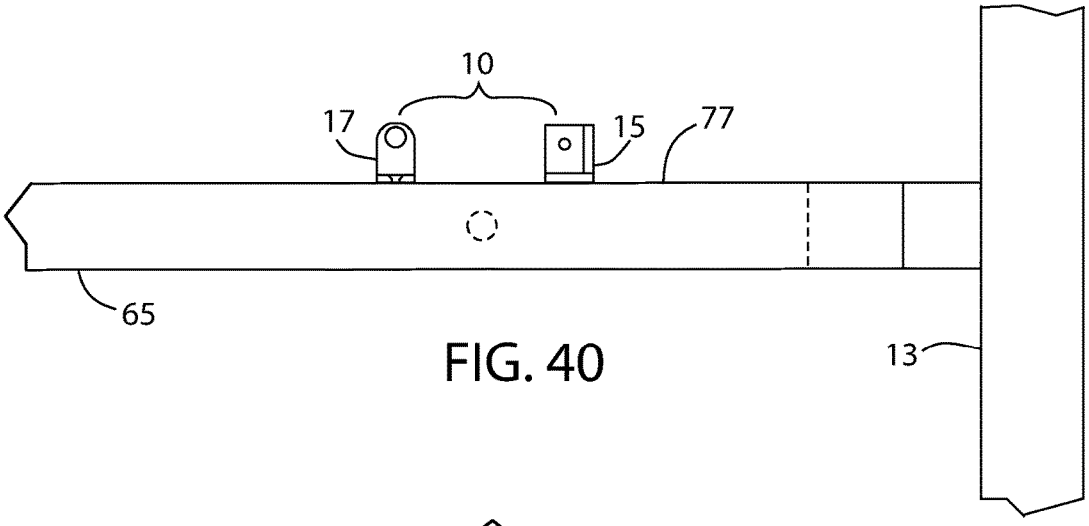
FIG. 40 shows a bottom view of the pivot door and door catch of FIG. 39 with the pivot door in the closed position.
Figure 41:
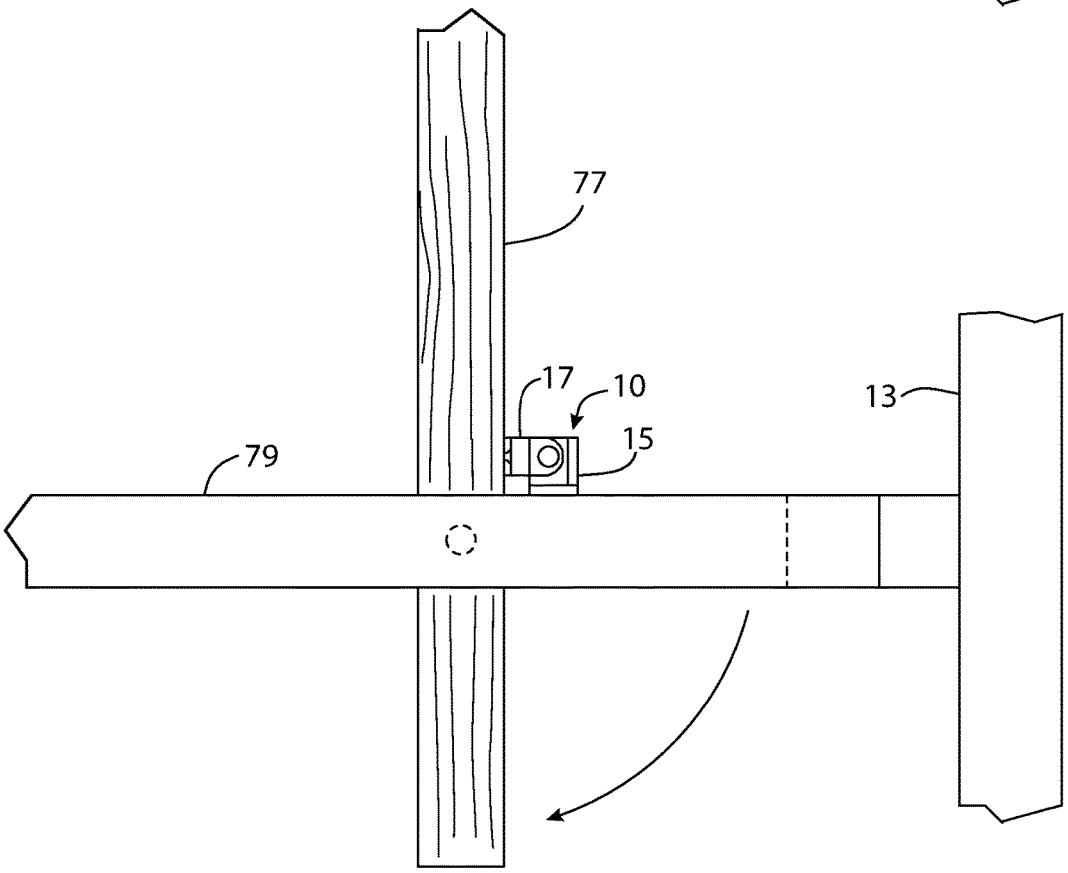
FIG. 41 shows a bottom view of the pivot door and door catch of FIG. 39 with the pivot door in the open position and with the door catch fully engaged.

The door catch of this disclosure may readily be adapted for use with a pivot door. FIG. 39 shows an upper portion of a pivot door 77 in a partially open position in top front perspective view. An alternative version of the door catch 10 is shown mounted to the top of the pivot door 77 with respect to a doorframe 79. FIG. 40 shows a bottom view of the pivot door 77, the door catch 10 of FIG. 39, the doorframe 79, and the wall 13 with the pivot door 77 in the closed position. FIG. 41 shows a bottom view of the pivot door 77 and door catch 10 of FIG. 39 with the pivot door 77 in the open position and with the door catch 10 fully engaged. FIG. 41 shows the pivot door 77 in relation to the doorframe 79 and the wall 13. In FIGS. 39-40, the door catch 10 includes a ball catch base 17 and a catch bar bracket 15. The same ball catch base 17 can be used as previously described, for example, in FIGS. 6-10, 23-25, and 32-33. Using the same ball catch base 17 across multiple applications simplifies manufacturing, forecasting, and inventory management.

Figure 42:
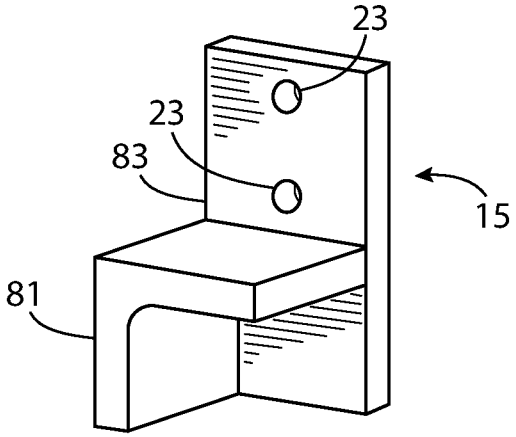
FIG. 42 shows a front perspective view of the catch bar bracket of the door catch of FIG. 39.
Figure 43:
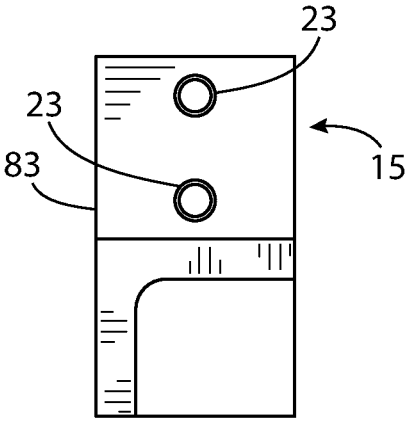
FIG. 43 shows a front view of the catch bar bracket of FIG. 42.
Figure 44:
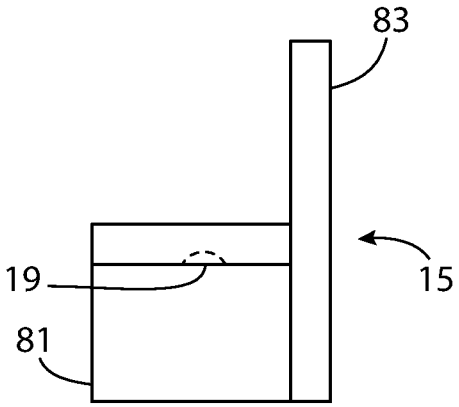
FIG. 44 shows a side view of the catch bar bracket of FIG. 43.
Figure 45:
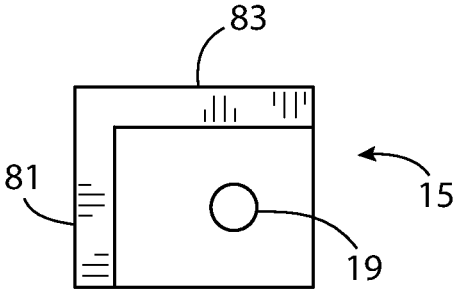
FIG. 45 shows a bottom view of the catch bar bracket of FIG. 44.
Figure 46:
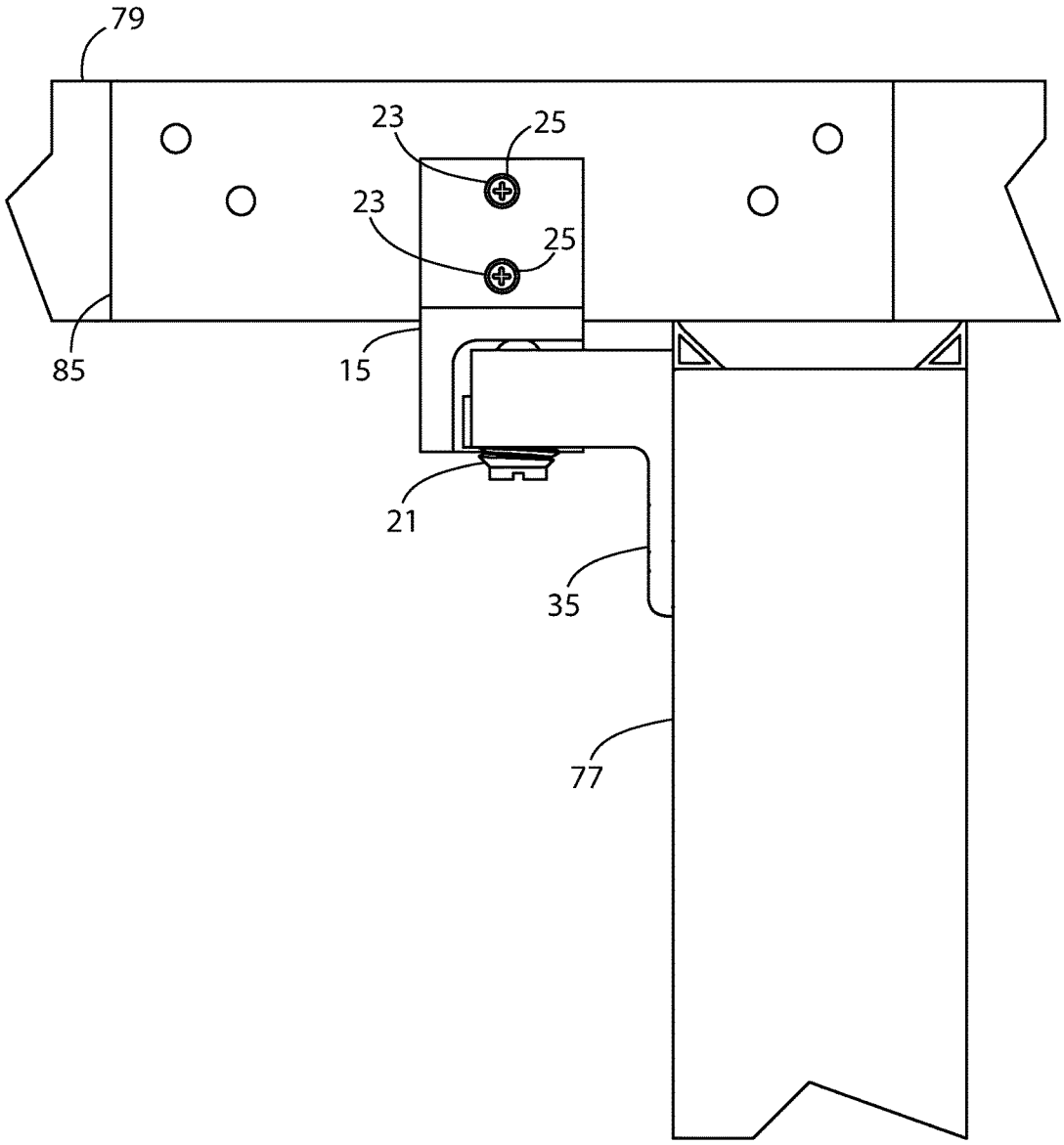
FIG. 46 shows a front detail view of the door catch assembly mounted to the door and door frame in closed position.

FIGS. 42-46 shows the catch bar bracket 15 of FIGS. 39-40 in several views. FIG. 42 shows the catch bar bracket 15 in a front perspective view, FIG. 43 in front view, FIG. 44 in side, and FIG. 45 in bottom view. Referring to FIGS. 42-45 the catch bar bracket 15 of FIGS. 39-40 includes a downward facing L-bracket portion 81 and a planar-back mounting portion 83. The planar-back mounting portion 83 is shown with apertures 23 for mounting the planar back to doorframe 79 of FIGS. 39-41. The apertures 23 of the catch bar bracket 15 of FIGS. 42-43, and 46 are round and countersunk to prevent any possibility of vertical or horizontal movement within the hole so as to withstand the rotational torque of the door with respect to its hinges in order prevent the door from sagging over time as previously discussed. In FIG. 46 the catch bar bracket 15 is shown secured to the doorframe 79 with threaded fasteners 25. A metal stiffener plate 85 is shown to provide added support if needed. In FIG. 44-45, the bottom the downward facing l-bracket portion 81 includes the detent 19 for frictionally engaging the top of the ball plunger assembly 21 of FIG. 46. Note that in FIG. 46, the ball plunger assembly 21 and the corresponding ball catch base 17 is mounted in the opposite direction as in FIG. 6-10. This reversible configuration allows the ball catch base 17 to be used in a variety of different applications. In FIG. 46, the ball catch base 17 is shown mounted to the door 11 with the mounting portion 35 facing downward. As in the other disclosed configurations, the ball plunger assembly 21 is rotationally adjustable from below.

Figure 47:
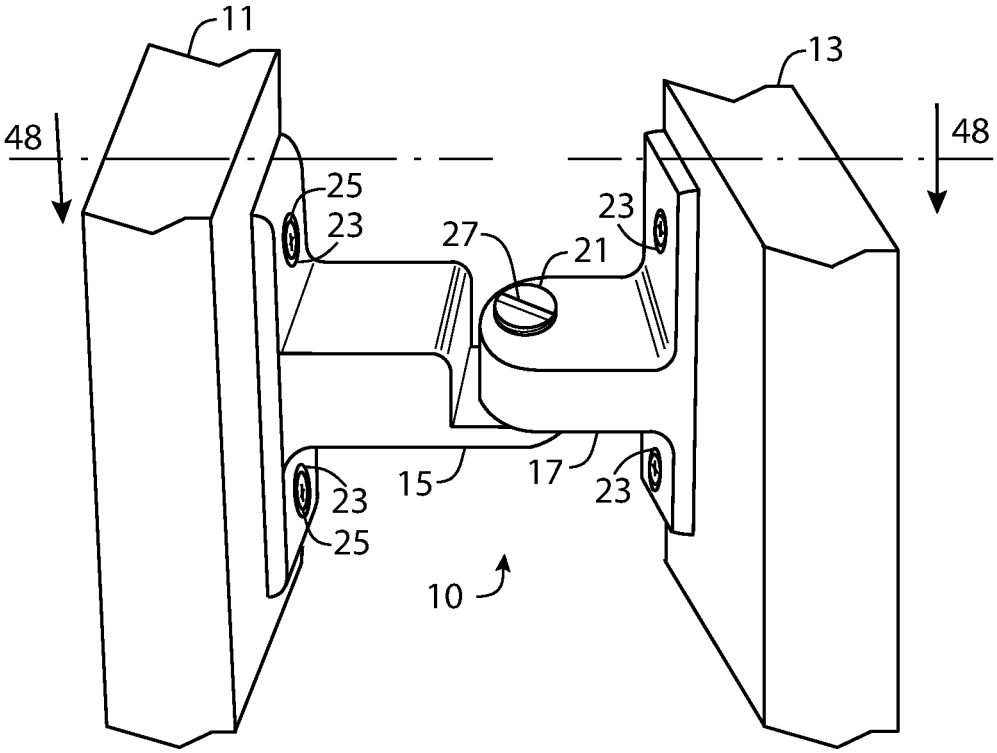
FIG. 47 shows an alternative door catch in top perspective view mounted to the bottom of a door and wall.
Figure 48:
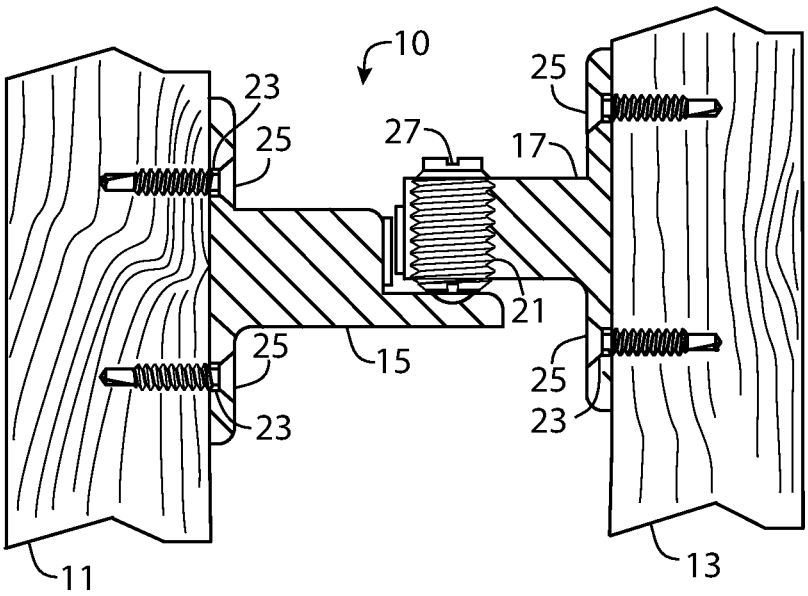
FIG. 48 shows a sectional view of the door catch of FIG. 47 shown along section lines 48-48.

FIG. 47 shows an alternative door catch in top perspective view mounted to the bottom of a door 11 and wall 13. FIG. 48 shows a sectional view of the door catch of FIG. 47 shown along section lines 48-48. Referring to FIGS. 47-48, the door is shown with the catch bar bracket 15 frictionally engaged with the ball plunger assembly 21 of the ball catch base 17 to hold the door open. The ball catch base 17 is shown with mounting portion extending perpendicularly upward and downward for additional support. This configuration allows the ball catch base 17 to be fully supported in either the upward facing or downward facing direction. In FIGS. 47-48, where the door catch 10 is mounted at the bottom of the door, the slot 27 of the ball plunger assembly 21 is facing upward for easy adjustment with a screwdriver or the like from above. As the ball plunger assembly is rotated so it screws downward and into the ball catch base 17, the ball plunger assembly 21 and catch bar bracket 15 become more frictionally engaged. As the ball plunger assembly is rotated so it screws upward and out of the ball catch base 17, the ball plunger assembly 21 and the catch bar bracket 15 become less frictionally engaged. Also shown in FIGS. 47-48 are the threaded fasteners 25 and aperture 23 for receiving the threaded fasteners 25 into either the door 11 or wall 13. In FIG. 48, both the wall 13 and the door 11 are shown as wood. The door 11 or wall 13 can also be any combination of standard door and wall materials. For example, the wall 13 can be drywall, metal, or concrete or a fiberglass frame and the door can include a fiberglass or metal frame structure in addition to the illustrated wood structure. Those skilled in the art will readily recognize other suitable door and wall materials.

The door catch thus far described has been applied to frictionally hold a door in an open position. It may also be desirable to frictionally hold a door in a closed position. For example, local fire and safety codes may require certain exit door include a crash bar or "panic bar" where a simple push on the bar releases the door for easy egress during an emergency. Many historical buildings require that their facade be maintained including the original doors and these may not suitable or adaptable for integration of a panic bar. In this situation it may be possible to adapt the door catch 10 described thus far to function in the closed position. For example by extending perpendicular brackets outward from the inside of the door and the wall to provide suitable mounting surfaces for the catch bar bracket 15 and ball catch base 17 while the door is in the closed position.

A novel door catch has been described. It is not the intent of this disclosure to limit the claimed invention to the examples, variations, and exemplary embodiments described in the specification. Those skilled in the art will recognize that variations will occur when embodying the claimed invention in specific implementations and environments. As an example, while the catch bar bracket is shown in specific examples mounted to a door and in others mounted to a wall, those skilled in the art will readily recognize from the disclosure that the catch bar bracket can be mounted on either the door or the wall in any of the examples. The same can be said for the ball catch base. In addition, various materials, for example, wood, metal, fiberglass, or drywall has been shown for the wall material in specific examples. Similarly, various material variations have been shown for the door. It should be understood, that the choice of material is simply as an aid in understanding the broad scope for which the disclosed door catch can be utilized. In each example, any of the other disclosed materials as well as any standard material for commercial or residential door and wall construction can be used to mount the door catch.

It is possible to implement certain features described in separate embodiments in combination within a single embodiment. Similarly, it is possible to implement certain features described in single embodiments either separately or in combination in multiple embodiments. It is the intent of the inventor that these variations fall within the scope of the claimed invention. While the examples, exemplary embodiments, and variations are helpful to those skilled in the art in understanding the claimed invention, it should be understood that, the scope of the claimed invention is defined solely by the following claims and their equivalents.

What is claimed is:

1. A door catch, comprising:

a ball plunger assembly including a body with a threaded exterior, a tool-engaging plunger base, a spring, and a ball captive within the body and loaded by the spring to partially extend out of the body opposite the tool-engaging plunger base;

a catch bar bracket including a first mounting portion and a catch bar base projecting directly away from the first mounting portion;

a catch bar including a catch bar bottom surface in which a detent is formed, the catch bar bottom surface being constrained to move along a top surface of the catch bar base with one degree of freedom, allowing incremental adjustment of the catch bar relative to the catch bar base;

a ball catch base including a second mounting portion and a base portion projecting directly away from the second mounting portion, the base portion including a base portion top surface and a base portion bottom surface with a threaded aperture therethrough that receives the ball plunger assembly;

the catch bar bracket and the ball catch base being mountable on opposing vertical surfaces of a mounting structure and a door by the first mounting portion and the second mounting portion, respectively, so that the ball and the detent frictionally engage vertically to hold the door in an open position, and a force of impinging of the ball against the detent is adjustable by rotating the body within the threaded aperture causing the ball to raise or lower with respect to the base portion top surface; and the catch bar bottom surface and the top surface of the catch bar base include complementary serrated portions that engage to hold the catch bar in one of its incremental adjusted positions relative to the catch bar base.

2. A door catch, comprising:

a ball plunger assembly including a body with a threaded exterior, a tool-engaging plunger base, a spring, and a ball captive within the body and loaded by the spring to partially extend out of the body opposite the tool-engaging plunger base;

a catch bar bracket including a first mounting portion and a catch bar base projecting directly away from the first mounting portion;

a catch bar including a catch bar bottom surface in which a detent is formed, the catch bar bottom surface being constrained to move along a top surface of the catch bar base with one degree of freedom, allowing incremental adjustment of the catch bar relative to the catch bar base;

a ball catch base including a second mounting portion and a base portion projecting directly away from the second mounting portion, the base portion including a base portion top surface and a base portion bottom surface with a threaded aperture therethrough that receives the ball plunger assembly;

the catch bar bracket and the ball catch base being mountable on opposing vertical surfaces of a mounting structure and a door by the first mounting portion and the second mounting portion, respectively, so that the ball and the detent frictionally engage vertically to hold the door in an open position, and a force of impinging of the ball against the detent is adjustable by rotating the body within the threaded aperture causing the ball to raise or lower with respect to the base portion top surface;

the catch bar bottom surface includes a first serrated portion;

the top surface of the catch bar base top surface includes a second serrated portion; and the catch bar bottom surface is slidable along the top surface of the catch bar base for the incremental adjustment of the catch bar relative to the catch bar base when the first serrated portion and the second serrated portion are not engaged with one another.

* * * * *